United States Patent [19]

Ito

[11] Patent Number: 4,932,216

[45] Date of Patent: Jun. 12, 1990

[54] ELECTRIC CONTROL APPARATUS FOR ICE MAKING MACHINE

[75] Inventor: Yoshinori Ito, Shimane, Japan

[73] Assignee: Hoshizaki Denki Kabushiki Kaisha, Toyoake, Japan

[21] Appl. No.: 413,661

[22] Filed: Sep. 28, 1989

[30] Foreign Application Priority Data

Sep. 28, 1988 [JP] Japan ..... 63-243147

[51] Int. Cl.[5] ..... F25B 49/00; F25C 1/04

[52] U.S. Cl. ..... 62/129; 62/233; 62/349

[58] Field of Search ..... 62/129, 130, 131, 125, 62/126, 127, 66, 71, 72, 73, 157, 158, 135, 136, 137, 138, 139, 228.2, 233, 340, 344, 347, 349, 350, 351, 352

[56] References Cited

U.S. PATENT DOCUMENTS

| | | | |
|---|---|---|---|
| 3,964,270 | 6/1976 | Dwyer | 62/158 |
| 4,573,325 | 3/1986 | Chiu et al. | 62/129 |
| 4,619,117 | 10/1986 | Ito | 62/233 |
| 4,852,361 | 8/1989 | Oike | 62/131 |

FOREIGN PATENT DOCUMENTS 62-261874 11/1987 Japan .

*Primary Examiner*—Harry B. Tanner

*Attorney, Agent, or Firm*—Armstrong, Nikaido, Marmelstein, Kubovcik & Murray

[57] ABSTRACT

In an ice making machine having a water plate pivotally supported by a support shaft in such a manner that the water plate is raised to an ice making position just below an ice forming evaporator unit during the freezing cycle of operation and lowered to a discharge position during the harvest cycle of operation, and a suspension mechanism which is arranged to suspend the water plate in place and is operated by an electric motor assembled therein to raise or lower the water plate, an electric control apparatus for the ice making machine is arranged to measure lapse of a first period of time during which the water plate is lowered by activation of the motor from the ice making position to the discharge position, to measure lapse of a second period of time during which the water plate is raised by activation of the motor from the discharge position to the ice making position, to determine as to whether or not each lapse of the first and second periods of time becomes more than a permissible period of time, to produce an output signal therefrom when each lapse of the first and second periods of time has become more than the permissible period of time and to deactivate the motor in response to the output signal.

4 Claims, 3 Drawing Sheets

ELECTRIC CONTROL APPARATUS FOR ICE MAKING MACHINE

BACKGROUND OF THE INVENTION

1. Field of the Invention

The present invention relates to an ice making machine the refrigeration section of which includes a water plate suspended by an electrically operated suspension mechanism to be raised during the freezing cycle of operation and lowered during the harvest cycle of operation, and more particularly to an electric control apparatus for the ice making machine to protect the component parts of the suspension mechanism from damage caused by unexpected trouble in operation.

2. Description of the Prior Art

In the refrigeration section of such ice making machines as described above, an ice forming evaporator unit is horizotally supported in place, and a flat water plate is pivotally supported by a support shaft in such a manner that the water plate may be raised to an ice making position just below the evaporator unit during the freezing cycle of operation and lowered to a discharge position during the harvest cycle of operation to permit discharge of formed ice cubes from the evaporator unit. The water plate is suspended at its movable end by means of a suspension mechanism which is operated by an electric motor assembled therein. If upward or downward movement of the water plate stops or becomes slow due to unexpected trouble in operation of the suspension mechanism, the electric motor will be applied with heavy load or locked. This causes overheat of the electric motor and damage of the component parts of the suspension mechanism.

SUMMARY OF THE INVENTION

It is, therefore, a primary object of the present invention to provide an electric control apparatus for the ice making machine capable of deactivating the electric motor of the suspension mechanism in the occurrence of unexpected trouble in operation and of informing the user of the trouble.

According to the present invention, the object is accomplished by providing an ice making machine having an ice forming evaporator unit horizontally supported in place, a water plate pivotally supported by a support shaft in such a manner that the water plate is raised to an ice making position just below the evaporator unit during the freezing cycle of operation and lowered to a discharge position during the harvest cycle of operation, and a suspension mechanism which is arranged to suspend the water plate in place and is operated by an electric motor assembled therein to raise or lower the water plate, wherein an electric control apparatus for the ice making machine comprises first means for measuring lapse of a first period of time during which the water plate is lowered by activation of the electric motor from the ice making position to the discharge position and for measuring lapse of a second period of time during which the water plate is raised by activation of the electric motor from the discharge position to the ice making position, second means for determining as to whether or not each lapse of the first and second periods of time becomes more than a permissible period of time and for producting an output signal therefrom when each lapse of the first and second periods of time has become more than the permissible period of time, and third means for deactivating the electric motor in response to the output signal from the second means. In the electric control apparatus, the permissible period of time is determined to correspond with a maximum period of time necessary for moving the water plate from the ice making position to the discharge position or vice versa in normal operation of the suspension mechanism.

In a practical embodiment of the present invention, it is preferable that the electric control apparatus comprises first means for measuring lapse of a first period of time during which the water plate is lowered by activation of the electric motor from the ice making position to the discharge position, second means for determining as to whether or not the lapse of the first period of time becomes more than a first permissible period of time and for producing a first output signal therefrom when the lapse of the first period of time has become more than the first permissible period of time, third means for measuring lapse of a second period of time during which the water plate is raised by activation of the electric motor from the discharge position to the ice making position, fourth means for determining as to whether or not the lapse of the second period of time becomes more than a second permissible period of time and for producing a second output signal therefrom when the lapse of the second period of time has become more than the second permissible period of time, and fifth means for deactivating the electric motor in response to the first output signal from the second means or the second output signal from the fourth means.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
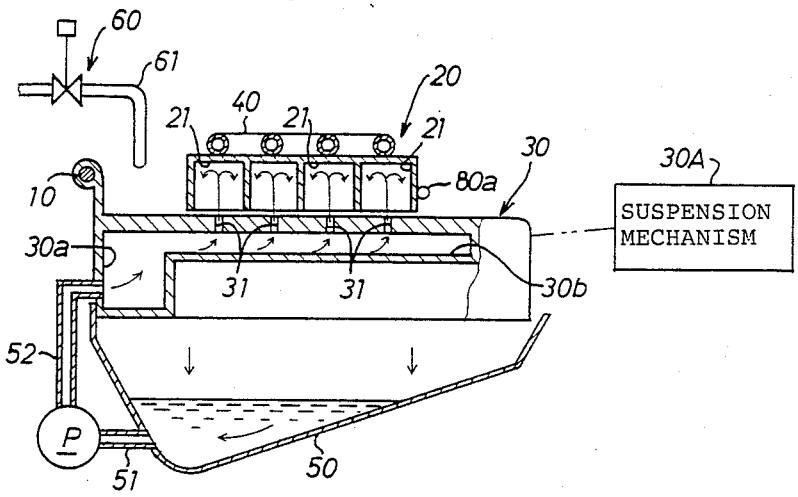
FIG. 1 is a vertical sectional view of the freezing mechanism in an ice making machine during the freezing cycle.
Figure 2:
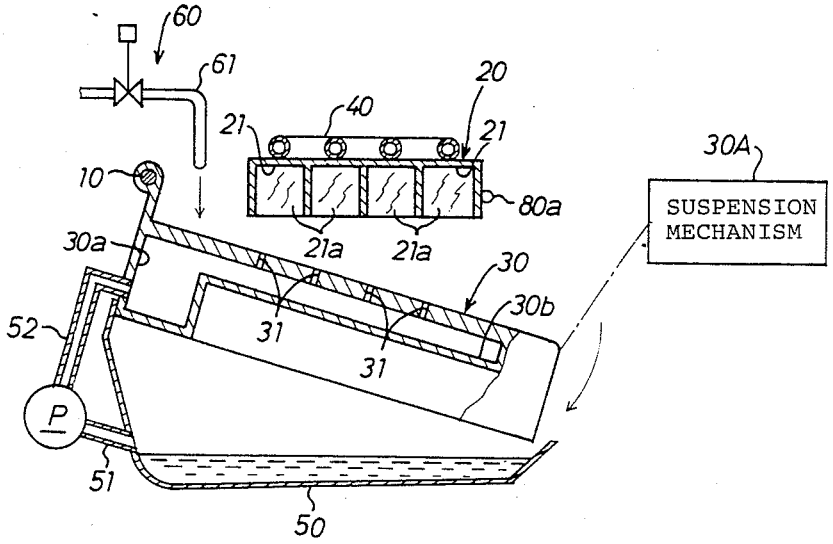
FIG. 2 is a vertical sectional view of the freezing mechanism during the harvest cycle.

In FIGS. 1 and 2 of the drawings there is schematically illustrated a freezing mechanism of an ice making machine which is operated under control of an electric control apparatus in accordance with the present invention. The freezing mechanism includes a flat water plate 30 which is pivotally supported by a support shaft 10 in such a manner that the water plate 30 may be raised to a cell closing or ice making position during the freezing cycle of operation and lowered to a discharge position during the harvest cycle of operation to permit discharge of formed ice cubes from an ice forming evaporator unit 20. The support shaft 10 is fixedly mounted on a stationary structure (not shown) in a refrigeration section of the ice making machine, and the evaporator unit 20 is horizontally supported in place within the refrigeration section. The evaporator unit 20 is provided thereon with a refrigeration evaporator coil 40 and is formed therein with a multiplicity of individual open-bottom freezing cells 21 in thermal exchange relationship with the evaporator coil 40.

During the freezing cycle of operation, the water plate 30 is horizontally retained in the ice making position by means of a conventional electrically operated suspension mechanism 30A to close the freezing cells 21 of evaporator unit 20 and to supply the water to be frozen into the freezing cells 21 therethrough from a water reservoir 50. A water pump P is connected at its inlet port to the water reservoir 50 through a pipe 51 and at its outlet port to a pressure chamber **30*a* through a pipe 52 to pick up the water from reservoir 50 and discharge it into the pressure chamber 30. The pressure chamber 30*a* is located under the water plate 30 and is integrally formed with a plurality of distribution chambers 30*b* one of which is illustrated in the figure. A multipilicity of holes 31 formed in the water plate 30 are centrally located in the bottom openings of freezing cells 21 when the water plate 30 is retained in the ice making position during the freezing cycle. During operation of the pump P, the water is supplied into the distribution chambers 30*b* through the pressure chamber 30*a* and spurts up into the freezing cells 21 through the holes 31 of water plate 30 to be formed into ice on the walls of cells 21. The water which is not immediately frozen will fall through return holes (not shown) in the water plate 30 back into the reservoir 50 to be recirculated again. Thus, the water in reservoir 50 will be recirculated until it is frozen into ice cubes in the freezing cells 21**.

After the freezing cycle has been terminated, as shown in FIG. 2, the water plate 30 is lowered under control of a water plate moving motor in the form of a reversible electric motor Ma (shown in the circuit diagram of FIG. 3) to open the freezing cells 21 of evaporator unit 20, an electrically operated hot gas defrost valve Vh (shown in FIG. 3) is opened to release the formed ice cubes from the freezing cells 21, and an electrically operated water supply valve 60 is opened to pour fresh water onto the water plate 30 through a water supply pipe 61. Thus, the ice cubes are discharged from the freezing cells 21 and slid down the water plate 30 to be harvested. In addition, the water supply pipe 61 is connected to a source of water to provide the fresh water necessary for the production of the ice cubes. Prior to the initiation of the following freezing cycle, the fresh water supplied from water supply pipe 61 is allowed to flow into the reservoir 50 when the water plate 30 is retained in the lowered discharge position. The quantity of fresh water introduced into reservoir 50 is controlled to be substantially equal to the amount of water required to produce the ice cubes in the freezing cells 21.

Figure 3:
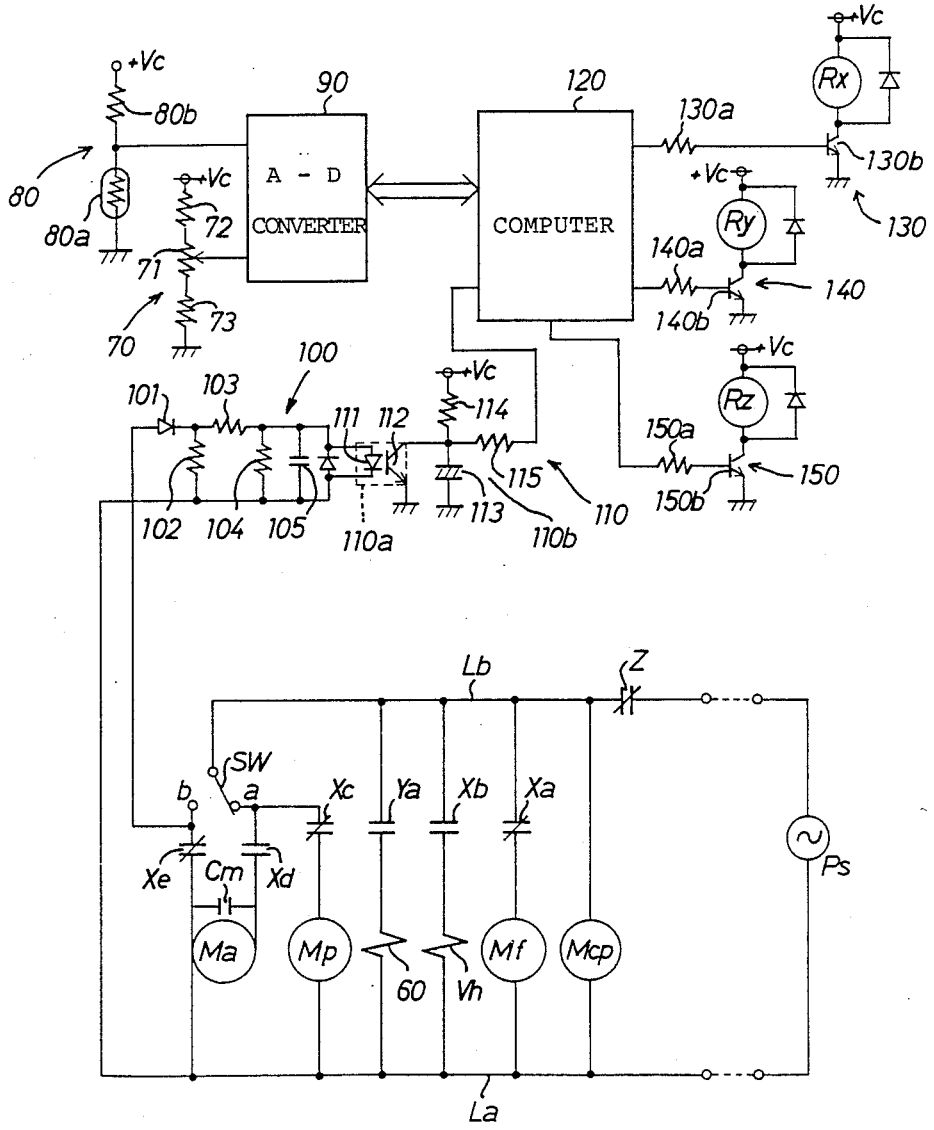
FIG. 3 is an electric control apparatus for the ice making machine.

In the ice making machine, the electrically operated suspension mechanism 30A includes a speed reduction unit (not shown) in drive connection with the electric motor Ma, a rotary lever (not shown) mounted on an output shaft of the speed reduction unit for rotation therewith, a suspension coil spring engaged at its one end with a movable end of the rotary lever and at its other end with a movable end of water plate 30 to support the water plate 30 in the cell closing position or the discharge position, and a changeover switch SW arranged to be switched over in response to upward or downward movement of the water plate 30. Assuming that the electric motor Ma has been activated to rotate in a forward direction, the speed reduction unit causes the rotary lever to rotate in one direction. Thus, the rotary lever cooperates with the suspension coil spring to raise the water plate 30 from the discharge position and retain it in the cell closing position. When the water plate 30 has been raised to the cell closing position, the movable contact of switch SW is connected to a first fixed contact a as shown in FIG. 3. When the electric motor Ma has been activated to rotate in a reverse direction, the speed reduction unit causes the rotary lever to rotate in the opposite direction. Thus, the rotary lever coopertes with the suspension coil spring to incline the water plate 30 downward from the cell closing position and retain it in the discharge position. When the water plate 30 has been inclined to the discharge position, the movable contact of switch SW is connected to a second fixed contact b shown in FIG. 3.

Hereinafter, the electric control apparatus for the ice making machine will be described in detail with reference to FIGS. 3 and 4. As shown in FIG. 3, the electric control apparatus includes a temperature setting circuit 70 composed of a variable resistor 71 connected in series with a pair of fixed resistors 72 and 73. In the temperature setting circuit 70, the variable resistor 71 coacts with the fixed resistors 72, 73 to divide a DC voltage +Vc into a divided voltage which is produced as an electric signal indicative of a desired freezing temperature. The control apparatus further includes a temperature detecting circuit 80 composed of a temperature sensor **80*a* connected in series with a fixed resistor 80*b*. As shown in FIGS. 1 and 2, the temperature sensor 80*a* is attached to an outer periphery of the evaporator unit 20 to detect a temperature of the freezing cells 21 and coacts with the resistor 80*b* to produce an electric signal indicative of the freezing temperature of cells 21. An analog-to-digital or A–D converter 90 is connected to the temperature setting and detecting circuits 70 and 80** to convert the electric signals into digital signals respectively indicative of the setting temperature and the freezing temperature.

The control apparatus further includes a rectifying circuit 100 composed of a diode 101, resistors 102–104 and a capacitor 105. In the rectifying circuit 100, the diode 101 rectifies an alternating voltage applied thereto from a commercially available power source Ps through common lines La, Lb, and the resistors 102–104 and capacitor 105 eliminates a high frequency component from the rectified voltage to produce a DC voltage at the opposite ends of capacitor 105. Connected to the rectifying circuit 100 is a pulse voltage generating circuit 110 which includes a photocoupler **110*a* composed of a light emitting diode 111 and a photo-transistor 112. The light emitting diode 111 is arranged to be energized by the DC voltage applied thereto from the capacitor 105 of rectifying circuit 100, and the photo-transistor 112 is arranged to be energized by a light beam applied thereto from the light emitting diode 111. The photo-transistor 112 is connected to a capacitor 113 which is charged with the DC voltage +Vc through a resistor 114 during deenergization of the photo-transistor 112. When the photo-transistor 112 is energized, the capacitor 113 discharges the charged DC voltage therefrom through transistor 112. A resistor 115 is connected to the photo-transistor 112, capacitor 113 and resistor 114 to produce a high level pulse voltage therefrom when applied with the charged voltage from capacitor 113 during deenergization of the photo-transistor 112 and to produce a low level pulse voltage therefrom when the capacitor 113 is discharged in response to energization of the photo-transistor 112**.

Figure 4:
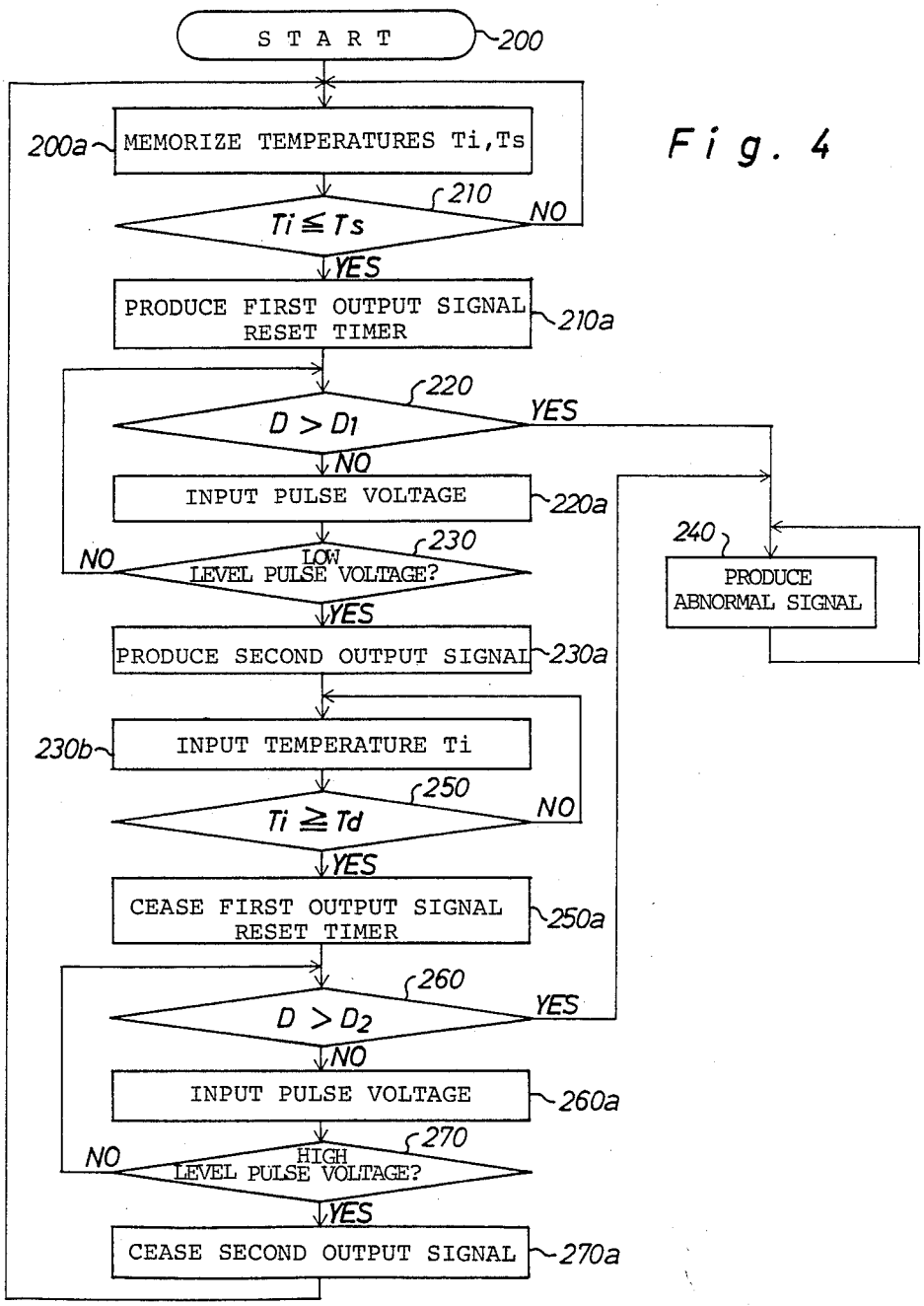
FIG. 4 is a flow chart of a control program executed by a microcomputer shown in FIG. 3.

A microcomputer 120 is connected to the A–D converter 90 and pulse voltage generating circuit 110 to execute a control program represented by a flow chart in FIG. 4. During execution of the control program, the computer 120 calculates each value necessary for activating driving circuits 130, 140 and 150 respectively connected with relay coils Rx, Ry and Rz. The driving circuit 130 is composed of a resistor 130*a* and a transistor 130*b*. The transistor 130*b* is energized by a first output signal applied thereto from computer 120 through resistor 130*a*. The relay coil Rx is arranged to coact with normally-closed relay switches Xa, Xc, Xe and normally-open relay switches Xb, Xd. When energized by energization of transistor 130*b*, the relay coil Rx causes the relay switches Xa, Xc, Xe to open and causes the relay switches Xb, Xd to close. The driving circuit 140 is composed of a resistor 140*a* and a transistor 140*b*. The transistor 140*b* is energized by a second output signal appied thereto from computer 120 through resistor 140*a*. The relay coil Ry is arranged to coact with a normally-open relay switch Ya. When energized by energization of transistor 140*b*, the relay coil Ry causes the relay switch Ya to close. The driving circuit 150 is composed of a resistor 150*a* and a transistor 150*b*. The transistor 150*b* is energized by an abnormal output signal applied thereto from computer 120 through resistor 150*a*. The relay coil Rz is arranged to coact with a normally-closed relay switch Z. When energized by energization of transistor 150*b*, the relay coil Rz causes the relay switch Z to open.

An electric motor Mp of the water pump P is connected to the first fixed contact a of changeover switch SW through the normally-closed switch Xc. In a first condition where the movable contact of switch Sw is maintained in contact with the first fixed contact a, the electric motor Mp is activated by the alternating voltage applied thereto from power source Ps through the normally-closed switches Z and Xc maintained in their closed positions. The electric motor Ma for moving the water plate 30 is arranged to rotate in a forward direction when applied with the alternating voltage from power source Ps through the relay switches Z and Xd maintained in their closed positions in the first condition where the movable contact of switch SW is maintaned in contact with the first fixed contact a. The electric motor Ma rotates in a reverse direction when applied with the alternating voltage from power source Ps through the relay switches Z and Xe maintained in their closed positions in a second condition where the movable contact of switch SW is maintained in contact with the second fixed contact b. In FIG. 3, a condenser Cm is provided to act the electric motor Ma as a condenser motor.

The electrically operated water supply valve 60 is connected to the power source Ps through the relay switches Z and Ya. When the relay switch Ya is closed in a condition where the relay switch Z is maintained in its closed position, the water supply valve 60 is opened by the alternating voltage applied thereto from power source Ps. The electrically operated hot gas defrost valve Vh is disposed within a bypass conduit (not shown) between an outlet port of a compressor in the refrigeration system and an inlet port of evaporator coil 40 and is electrically connected to the power source Ps through the relay switches Z and Xb. When the relay switch Xb is closed in a condition where the relay switch Z is maintained in its closed position, the defrost valve Vh is opened by the alternating voltage applied thereto from power source Ps to permit the gaseous refrigerant supplied into the evaporator coil 40 therethrough from the compressor. An electric motor Mf is provided to drive a cooling fan (not shown) for a condensing coil connected to the compressor. The electric motor Mf is connected to the power source Ps through the relay switches Z and Xa. When the relay switches Z and Xa are maintained in their closed positions, the electric motor Mf is activated by the alternating voltage applied thereto from power source Ps to rotate the cooling fan. An electric motor Mcp is connected to the power source Ps through the relay switch Z to drive the compressor when applied with the alternating voltage from power source Ps through the relay switch Z maintained in its closed position.

Assuming that the water plate 30 is retained in the cell closing position during the freezing cycle of operation, the relay switches Z and Xa are maintained in their closed positions to activate the electric motors Mcp and Mf for driving the compressor and cooling fan, the relay switches Xb and Ya are maintained in their open positions to close the defrost valve Vh and water supply valve 60, and the movable contact of changeover switch SW is maintained in contact with the first fixed contact a to apply the alternating voltage from power source Ps to the electric motor Mp through the relay switches Z and Xc. Thus, the motor Mp is activated to drive the water pump P, and the motor Ma is maintained in its deactivated condition. The water picked up by water pump P is supplied into the distribution chambers 30*b* through pressure chamber 30*a* and spurts up into the freezing cells 21 through the holes 31 of water plate 30 to be formed into ice on the walls of cells 21. The water which is not immediately frozen will fall through the return holes of water plate 30 back into the reservoir 50. The water in reservoir 50 will be recirculated into the freezing cells 21 until completely frozen into ice cubes.

In such a condition as described above, the computer 120 starts to execute the control program at step 200 in the flow chart shown in FIG. 4. At the following step 200*a*, the computer 120 is applied with digital signals respectively indicative of an actual freezing temperature Ti of cells 21 and a desired freezing temperature Ts from the A–D converter 90 to temporarily memorize them. Subsequently, the computer determines at step 210 as to whether or not the actual freezing temperature Ti is lower than or equal to the desired temperature Ts. When the answer is "No", the computer will repeat the execution at steps 200*a* and 210. When the actual freezing temperature Ti becomes lower than or equal to the desired temperature Ts, the computer determines a "Yes" answer at step 210 and causes the program to proceed to step 210*a* where the computer produces a first output signal therefrom and resets a timer to start measurement of a first permissible period of time $D_1$. Thus, the transistor 130*b* of driving circuit 130 is turned on in response to the first output signal from computer 120 to energize the relay coil Rx. In response to energization of the relay coil Rx, the relay switches Xa, Xc and Xe are opened to deactivate the motors Mf and Mp, while the relay switches Xb and Xd are closed to apply the alternating voltage from power source Ps to the hot gas defrost valve Vh and the water plate moving motor Ma. As a result, the motor Ma is activated to rotate in the forward direction, and the defrost valve Vh is opened to permit supply of hot gases from the compressor to the evaporator coil 40 for releasing the formed ice cubes from the freezing cells 21. In this instance, the rotary lever of suspension mechanism 30A is rotated in one direction in accordance with the forward rotation of motor Ma to incline the water plate 30 downward from the cell closing position.

After execution at step 210a, the computer determines at step 220 as to whether or not the lapse of time D is more than the first permissible period of time $D_1$. In this embodiment, the first permissible period of time $D_1$ is determined to correspond with a maximum period of time necessary for moving the water plate 30 from the ice making position to the discharge position under a normal condition of the suspension mechanism 30A. In normal operation of the suspension mechanism 30A, the computer determines a "No" answer at step 220 and causes the program to proceed to step 220a. In this instance, the computer is applied with a high level pulse voltage from the pulse voltage generating circuit 110 at step 220a since the photo-transistor 112 is still maintained in its deenergized condition during downward movement of the water plate 30. Thus, the computer determines a "No" answer at the following step 230 to repeat execution at steps 220, 220a and 230. If the downward movement of water plate 30 stops or becomes slow due to unexpected trouble in operation of the suspension mechanism 30A during repetitive execution at steps 220, 220a and 230, the computer determines a "Yes" answer at step 220 and causes the program to proceed to step 240 where the computer produces an abnormal output signal therefrom. In response to the abnormal output signal from computer 120, the transistor 150b of driving circuit 150 is turned on to energize the relay coil Rz, and the relay switch Z is opened by energization of the relay coil Rz to disconnect the power line Lb from the power source Ps. As a result, the motors Ma and Mcp are deactivated to protect the component parts of the suspension mechanism 30A from damage caused by continuous rotation of the motor Ma.

When the water plate 30 is inclined downward by normal operation of the suspension mechanism 30A and retained in the discharge position during repetitive execution at steps 220, 220a and 230, the movable contact of changeover switch SW is brought into contact with the second fixed contact b to deactivate the motor Ma and to apply the alternating voltage from power source Ps to the rectifying circuit 100. When applied with the alternating voltage, the rectifying circuit 100 produces a DC voltage therefrom, and the light emitting diode 111 of photocoupler 110a is energized by the DC voltage to emit a light beam therefrom. Thus, the photo-transistor 112 is energized by the light beam applied thereto to discharge the capacitor 113. This causes the resistor 115 to produce a low level pulse voltage therefrom. When applied with the low level pulse voltage, the computer determines a "Yes" answer at step 230 and causes the program to proceed to step 230a where the computer produces a second output signal therefrom. In response to the second output signal, the transistor 140b of driving circuit 140 is turned on to energize the relay coil Ry, and the relay switch Ya is closed by energization of the relay coil Ry to apply the alternating voltage from power source Ps to the water supply valve 60. Thus, the water supply valve 60 is opened to pour fresh water onto the water plate 30 through the water supply pipe 61 so that the formed ice cubes drop from the freezing cells 21 and fall over the surface of water plate 30 to be discharged into an ice storage bin.

When the program proceeds to step 230b, the computer is applied with a digital signal indicative of the actual freezing temperature Ti from the A-D converter 90 to determine at step 250 as to whether or not the actual temperature of freezing cells 21 is higher or equal to a defrost temperature Td. If the answer is "No" at step 250, the computer will repeat execution at steps 230b and 250. When the actual temperature of freezing cells 21 becomes higher or equal to the defrost temperature Td, the computer determines a "Yes" answer at step 250 and causes the program to proceed to step 250a. At step 250a, the computer causes the first output signal to disappear and resets the timer to start measurement of a second permissible period of time $D_2$. In this embodiment, the second permissible period of time $D_2$ is determined to correspond with a maximum period of time necessary for moving the water plate 30 from the discharge position to the ice making position in normal operation of the suspension mechanism 30A. Thus, the transistor 130b of driving circuit 130 is turned off to deenergize the relay coil Rx. In response to deenergization of the relay coil Rx, the relay switches Xa, Xc and Xe are closed to activate the motors Mf and Ma, while the relay switches Xb and Xd are opened to deactivate the defrost valve Vh. In this instance, the motor Ma is applied with the alternating voltage from power source Ps through the closed relay switch Xe in the second condition where the movable contact of changeover switch SW is still maintained in contact with the second fixed contact b. As a result, the motor Ma rotates in the reverse direction, and the rotary lever of suspension mechanism 30A is rotated in the opposite direction in accordance with the reverse rotation of motor Ma to raise the water plate 30.

After execution at step 250a, the computer determines at step 260 as to whether or not the lapse of time D is more than the second permissible period of time $D_2$. In normal operation of the suspension mechanism 30A, the computer determines a "No" answer at step 260 and causes the program to proceed to step 260a. In this instance, the computer is applied with a low level pulse voltage from the pulse voltage generating circuit 110 at step 260a since the photo-transistor 112 is still maintained in its energized condition during upward movement of the water plate 30. Thus, the computer determines a "No" answer at the following step 270 to repeat execution at steps 260, 260a and 270. If the upward movement of water plate 30 stops or becomes slow due to unexpected trouble in operation of the suspension mechanism 30A during repetitive execution at steps 260, 260a and 270, the computer determines a "Yes" answer at step 260 and causes the program to proceed to step 240 where the computer produces an abnormal output signal therefrom as described above. In response to the abnormal output signal from computer 120, the transister 150b of driving circuit 150 is turned on to energize the relay coil Rz, and the relay switch Z is opened by energization of the relay coil Rz to disconnect the power line Lb from the power source Ps. As a result, the motors Ma, Mcp and Mf are deactivated to protect the component parts of the suspension mechanism 30A from damage caused by continuous rotation of the motor Ma.

When the water plate 30 is raised by normal operation of the suspension mechanism 30A and retained in the cell closing position during repetitive execution at steps 260, 260a and 270, the movable contact of changeover switch SW is brought into contact with the first fixed contact a to deactivate the motor Ma and to disconnect the rectifying circuit 100 from the power source Ps. Thus, the rectifying circuit 100 causes the DC voltage to disappear, the pulse voltage generating circuit 110 produces a high level pulse voltage therefrom, and the motor Mp is activated by the alternating voltage applied thereto from the power source Ps through the closed relay switch Xc. When applied with the high level pulse voltage, the computer determines a "Yes" answer at step 270 and causes the program to proceed to step **270*a* where the computer causes the second output signal to disappear. As a result, the transistor 140*b* of driving circuit 140 is turned off to deenergize the relay coil Ry, and the relay switch Ya is opened to close the water supply valve 60**.

Having now fully set forth both structure and operation of a preferred embodiment of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims the invention may e practiced otherwise than as specifically set forth herein.

What is claimed is:

1. An electric control apparatus for an ice making machine having an ice forming evaporator unit horizontally supported in place, a water plate pivotally supported by a support shaft in such a manner that the water plate is raised to an ice making position just below the evaporator unit during the freezing cycle of operation and lowered to a discharge position during the harvest cycle of operation, and a suspension mechanism which is arranged to suspend the water plate in place and is operated by an electric motor assembled therein to raise or lower the water plate, the electric control apparatus comprising:

first means for measuring lapse of a first period of time during which said water plate is lowered by activation of said electric motor from the ice making position to the discharge position and for measuring lapse of a second period of time during which said water plate is raised by activation of said electric motor from the discharge position to the ice making position;

second means for determining as to whether or not each lapse of said first and second periods of time becomes more than a permissible period of time and for producting an output signal therefrom when each lapse of said first and second periods of time has become more than the permissible period of time; and third means for deactivating said electric motor in response to the outoput signal from said second means.

2. An electric control apparatus as claimed in claim 1, wherein the permissible period of time is determined to correspond with a maximum period of time necessary for moving said water plate from the ice making position to the discharge position or vice versa in normal operation of said suspension mechanism.

3. An electric control apparatus for an ice making machine having an ice forming evaporator unit horizontally supported in place, a water plate pivotally supported by a support shaft in such a manner that the water plate is raised to an ice making position just below the evaporator unit during the freezing cycle of operation and lowered to a discharge position during the harvest cycle of operation, and a suspension mechanism which is arranged to suspend the water plate in place and is operated by an electric motor assembled therein to raise or lower the water plate, the electric control apparatus comprising:

first means for measuring lapse of a first period of time during which said water plate is lowered by activation of said electric motor from the ice making position to the discharge position;

second means for determining as to whether or not the lapse of said first period of time becomes more than a first permissible period of time and for producing a first output signal therefrom when the lapse of said first period of time has become more than the first permissible period of time;

third means for measuring lapse of a second period of time during which said water plate is raised by activation of said electric motor from the discharge position to the ice making position;

fourth means for determining as to whether or not the lapse of said second period of time becomes more than a second permissible period of time and for producing a second output signal therefrom when the lapse of said second period of time has become more than the second permissible period of time; and fifth means for deactivating said electric motor in response to the first output signal from said second means or the second output signal from said fourth means.

4. An electric control apparatus as claimed in claim 3, wherein the first permissible period of time is determined to correspond with a maximum period of time necessary for moving said water plate from the ice making position to the discharge position in normal operation of said suspension mechanism, and wherein the second permissible period fo time is determined to correspond with a maximum period of time necessary for moving said water plate from the discharge position to the ice making position in normall operation of said suspension mechanism.

* * * * *